US005265922A

United States Patent [19]

Falcone

[11] Patent Number: 5,265,922

[45] Date of Patent: Nov. 30, 1993

[54] DETACHABLE DOOR LOCK MEMBER FOR HINGE SIDE OF DOOR

[76] Inventor: Gregory Falcone, 11 Orchard Rd., Fleetwood, Pa. 19522

[21] Appl. No.: 779,674

[22] Filed: Oct. 21, 1991

[51] Int. Cl.[5] ..... E05F 5/02

[52] U.S. Cl. ..... 292/258; 292/DIG. 17; 292/288; 16/375; 16/50; 16/86 B

[58] Field of Search ..... 292/288, DIG. 17, 258, 292/259; 16/86 B, 80, 82, 50, 333, 375

[56] References Cited

U.S. PATENT DOCUMENTS

| | | | |
|---|---|---|---|
| 1,616,265 | 2/1927 | Kroehling | 292/288 |
| 1,903,251 | 3/1933 | Ahrens . | |
| 2,055,743 | 9/1936 | Falcone | 16/82 |
| 2,201,594 | 5/1940 | Sitts | 292/76 |
| 2,237,148 | 4/1941 | Kaptuller | 16/375 |
| 2,331,150 | 10/1943 | Whiting, Jr. | 292/288 |
| 2,550,626 | 4/1951 | Vollmer | 202/262 |
| 2,592,230 | 4/1952 | Allen | 16/137 |
| 2,638,620 | 5/1953 | Civitelli | 16/137 |
| 2,799,888 | 7/1957 | White | 16/82 |
| 2,849,748 | 9/1958 | Angstadt | 16/85 |
| 2,976,563 | 3/1961 | Crisera | 16/333 |
| 2,990,572 | 7/1961 | Schwartzberg | 16/191 |
| 2,993,226 | 7/1961 | Baker, Jr. et al. | 16/191 |
| 3,135,012 | 6/1964 | Wessel | 16/137 |
| 3,157,906 | 11/1964 | Wolf | 16/50 |
| 3,174,179 | 3/1965 | Benson | 16/137 |
| 3,187,372 | 6/1965 | Parsons | 16/137 |
| 3,206,793 | 9/1965 | Silverberg | 16/137 |
| 3,425,386 | 2/1969 | Campbell | 16/375 |
| 3,602,942 | 9/1971 | Neff et al. | 16/191 |
| 3,805,325 | 4/1974 | Lee | 16/137 |
| 3,811,150 | 5/1974 | Chalmers | 292/DIG. 17 |
| 3,913,171 | 10/1975 | Reid | 16/82 |
| 3,969,788 | 7/1976 | McCullough | 292/DIG. 17 |
| 3,971,100 | 7/1976 | Anop | 16/82 |
| 4,079,972 | 3/1978 | Hagopian | 292/259 R |
| 4,259,762 | 4/1981 | Civitelli | 16/86 |
| 4,439,758 | 3/1984 | Cantley | 292/288 |
| 4,527,303 | 7/1985 | Civitelli | 16/86 |
| 4,671,014 | 6/1987 | Lack | 49/394 |

FOREIGN PATENT DOCUMENTS

| | | | |
|---|---|---|---|
| 920930 | 3/1963 | United Kingdom | 16/82 |

*Primary Examiner*—Eric K. Nicholson
*Attorney, Agent, or Firm*—Seidel, Gonda, Lavorgna & Monaco

[57] ABSTRACT

A detachable door lock having a door contact member which is secured to a door frame contact member. A spacer is provided between the door contact member and the door frame contact member so as to position the two members in contact with the door and the door frame, respectively. The door contact member and the door frame contact member, as well as the spacer, are releasably secured to the door hinge to maintain the door contact member in contact with the door and the door frame contact member in contact with the door frame. The door lock limits the amount of rotation of the door about the hinge and thus prevents entry through the doorway when the door is closed and the lock is attached to the hinge. The door lock may be adjusted so as to conform to various door and door frame configurations as well as to permit limited opening of the door.

5 Claims, 6 Drawing Sheets

FIG. 1
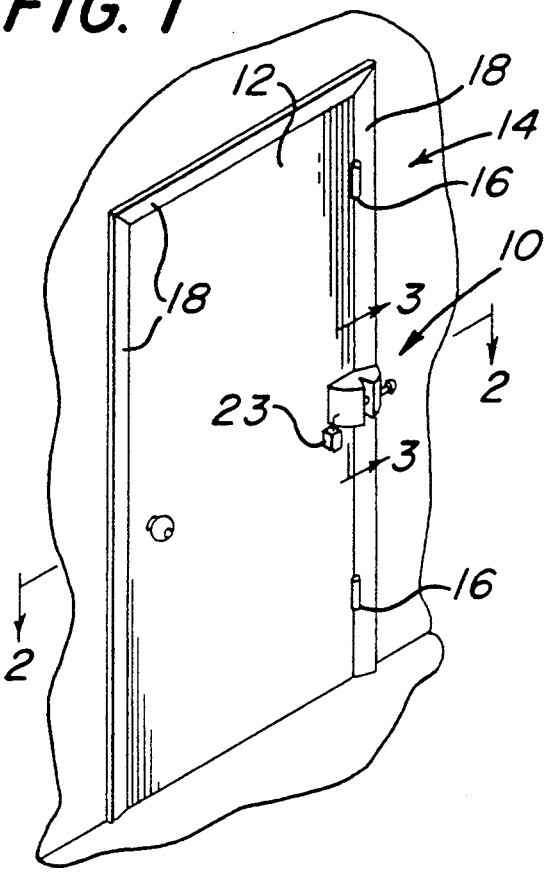
FIG. 3
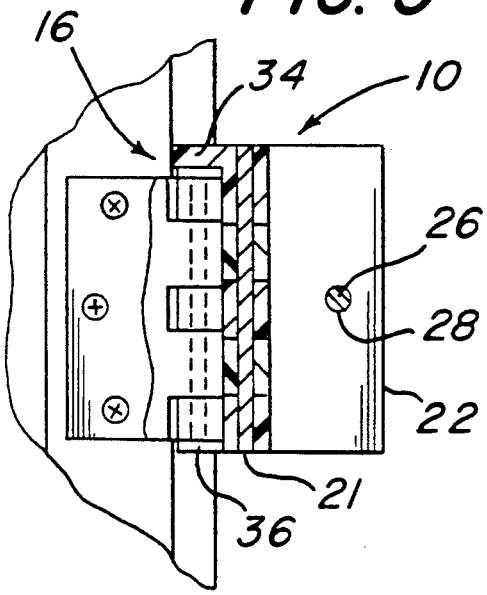
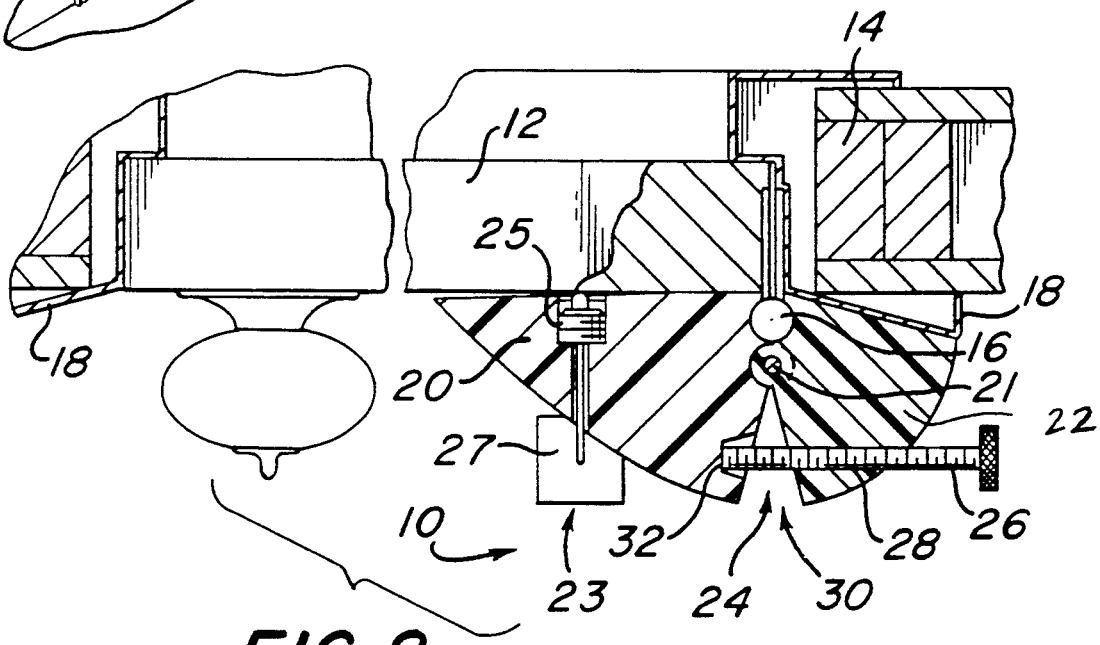
FIG. 2

FIG. 4
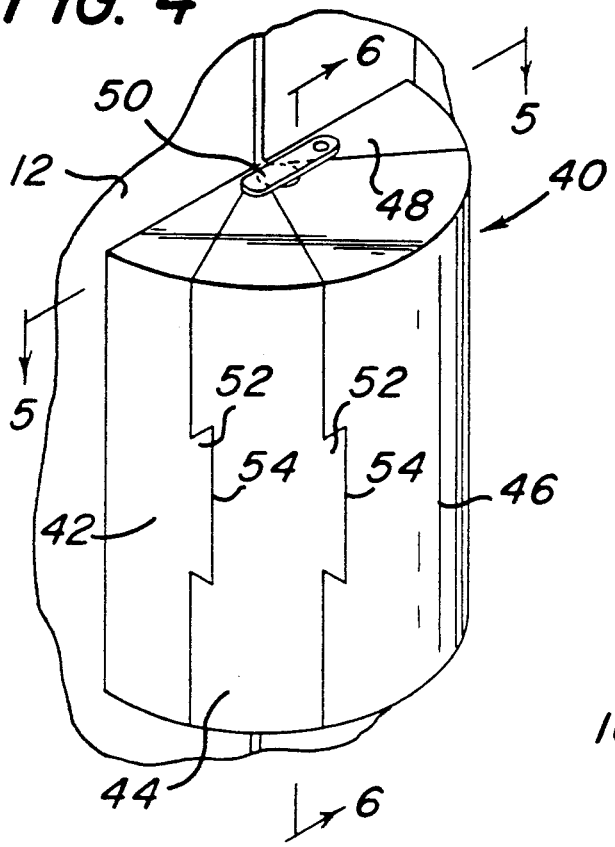
FIG. 6
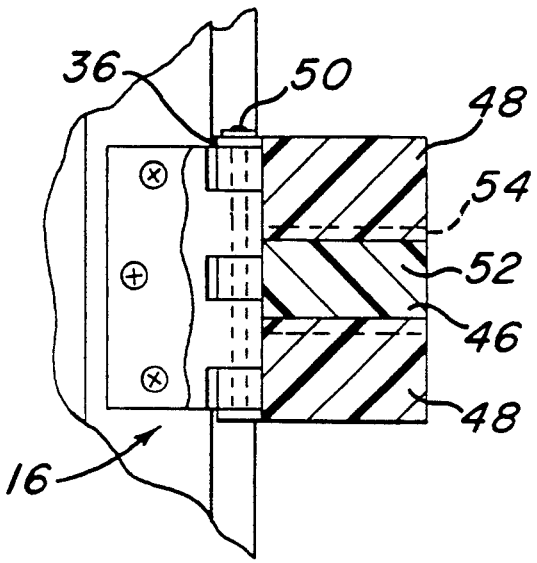
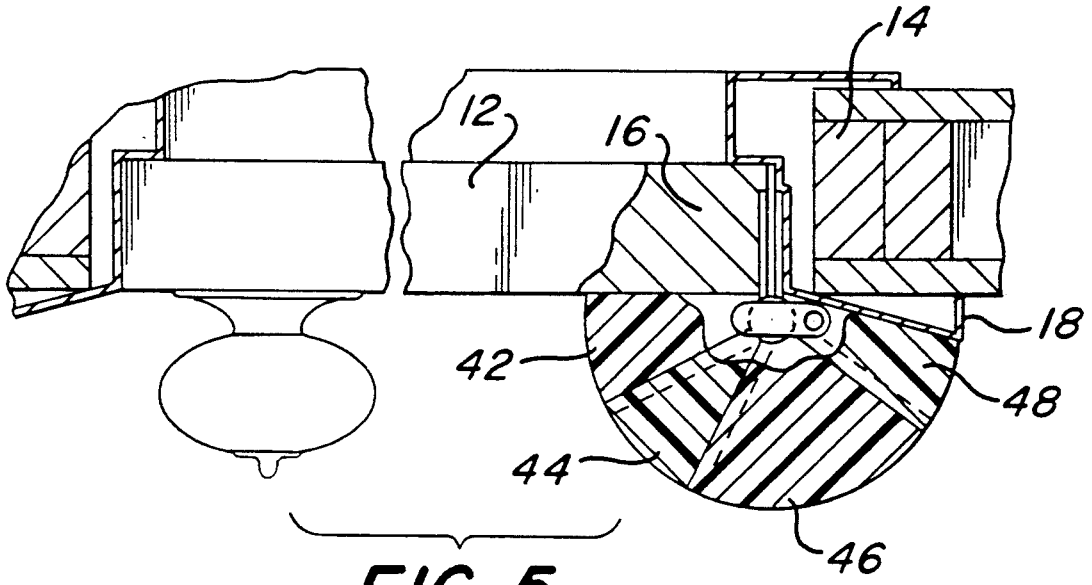
FIG. 5

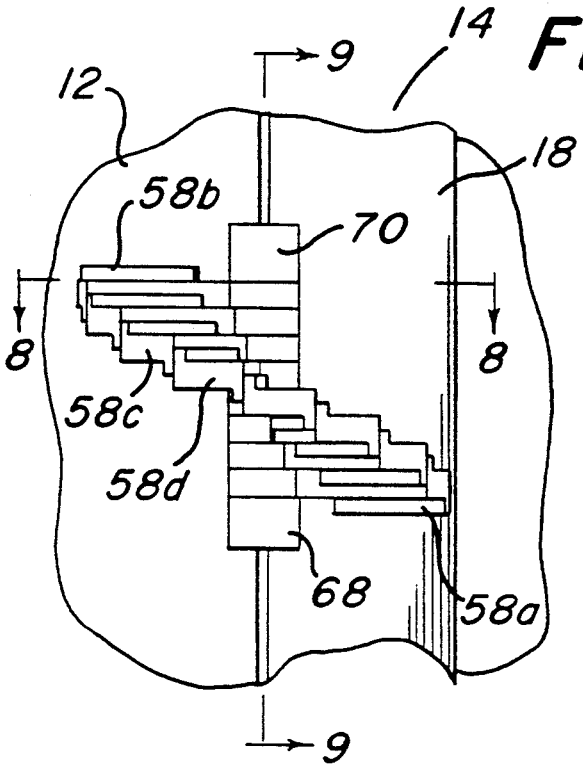
FIG. 7
FIG. 9
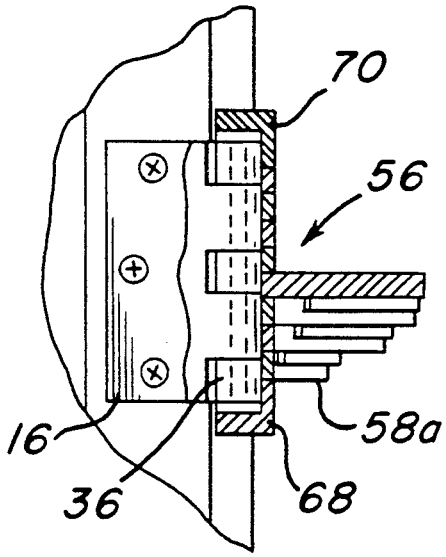
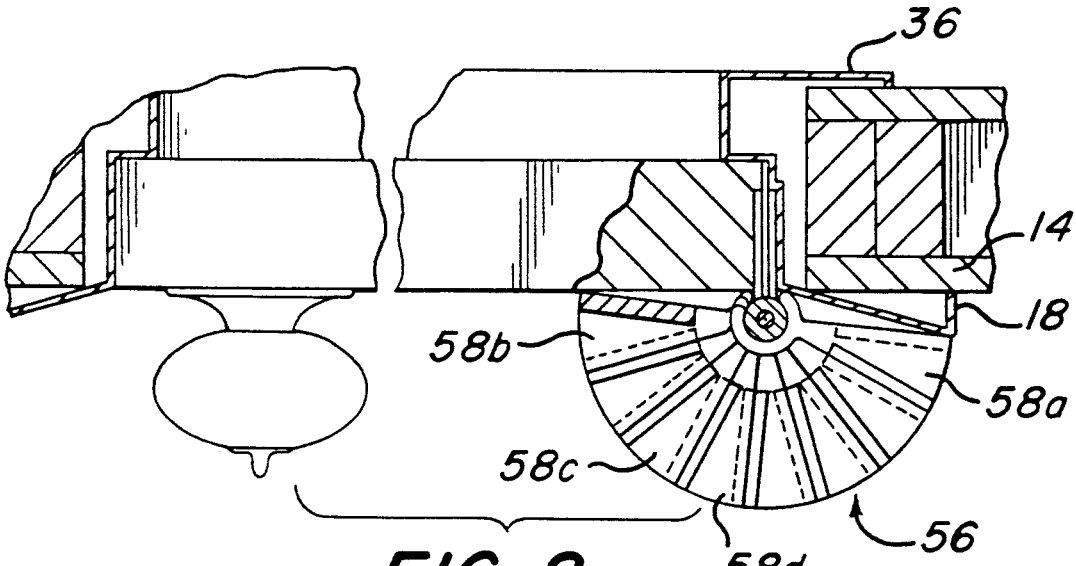
FIG. 8

FIG. 12
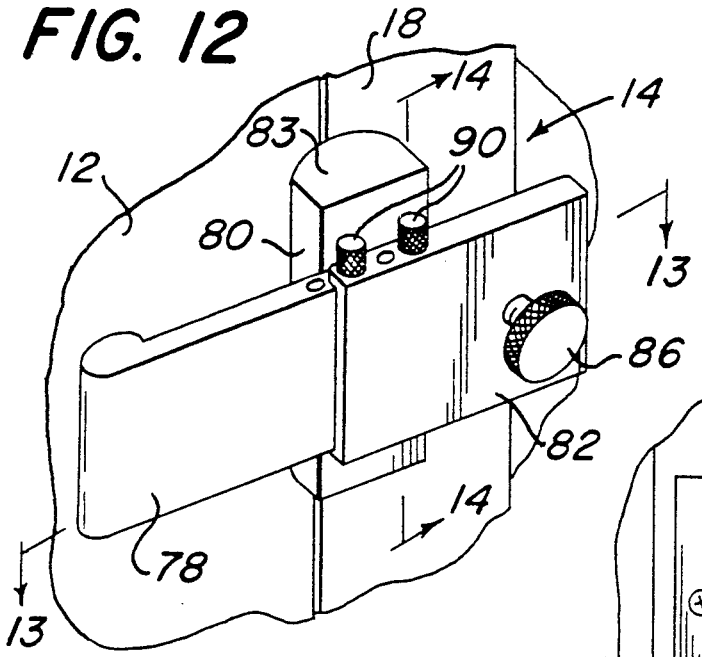
FIG. 14
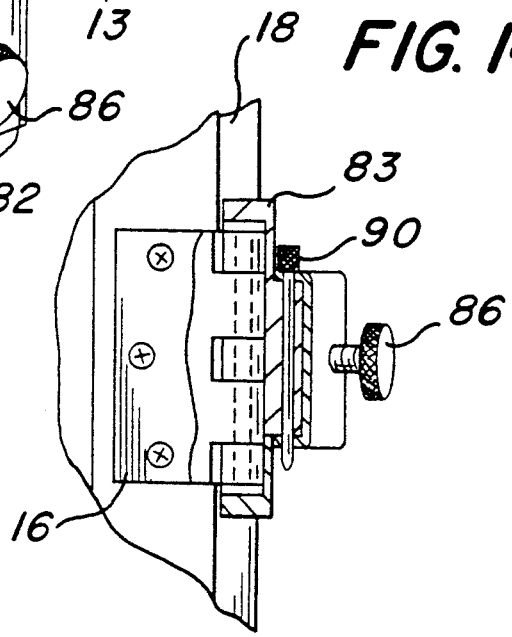
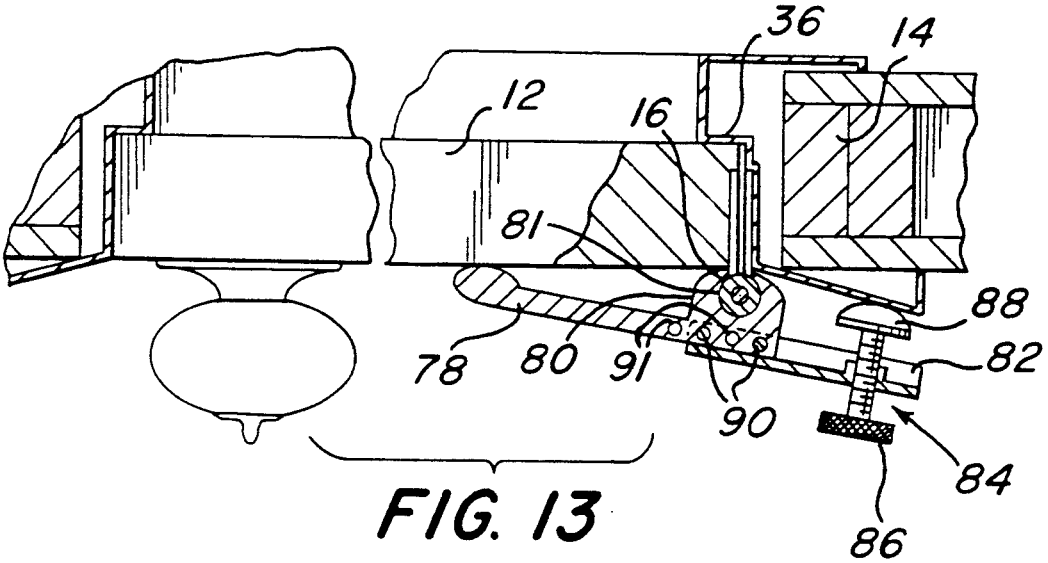
FIG. 13

FIG. 15
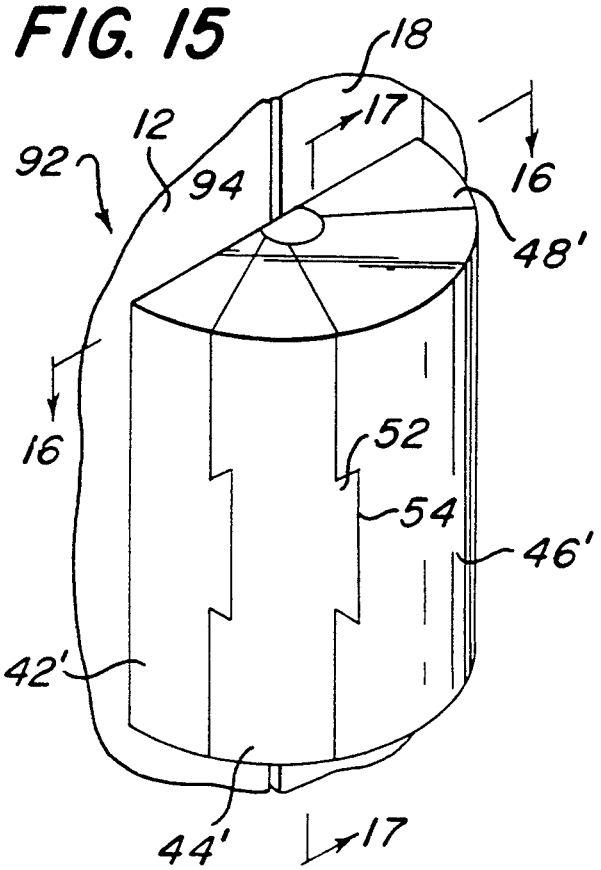
FIG. 17
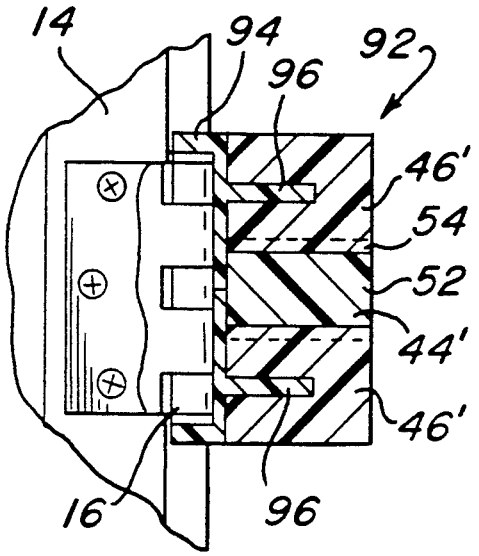
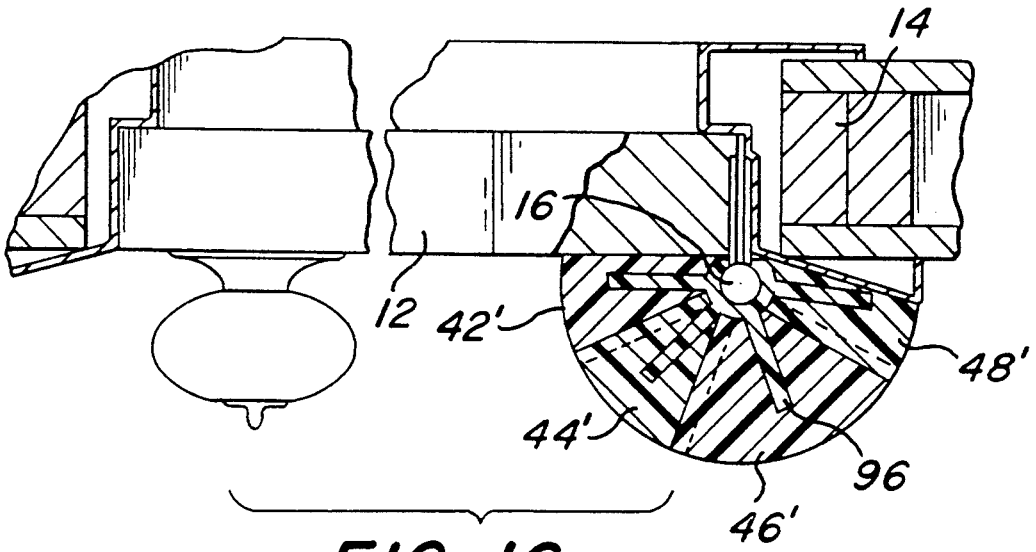
FIG. 16

DETACHABLE DOOR LOCK MEMBER FOR HINGE SIDE OF DOOR

BRIEF SUMMARY OF THE INVENTION

The present invention relates generally to a detachable door locking element which is adapted to be placed on the hinge of a door or the like so as to maintain the door in a closed position or to limit the amount of opening of the door. The locking element of the present invention is intended to maintain the door in a closed position by preventing rotation thereof about the hinge. There are a number of embodiments disclosed in the present application. Each generally includes a door contact member, a door frame contact member, a spacer for fixing the relative position between the door contact member and the door frame contact member, and an attachment element for releasably securing the door contact member and the door frame contact member to the door hinge. The present invention may be carried during traveling or the like and placed on a door so as to prevent entry. The present invention may also serve as a spacer whereby the door may be opened a limited amount without a person gaining access through the door.

BRIEF DESCRIPTION OF THE DRAWINGS

For purposes of illustrating the invention, there is shown in the drawings forms which are presently preferred; it being understood, however, that this invention is not limited to the precise arrangements and instrumentalities shown.

FIG. 1 shows a door having a first embodiment of the invention attached thereto.

FIG. 2 is a cross-sectional view of the first embodiment of the present invention as taken along line 2—2 in FIG. 1.

FIG. 3 is a second cross-sectional view of the first embodiment of the present invention as taken along line 3—3 in FIG. 1.

FIG. 4 is a perspective view of a second embodiment of the present invention.

FIG. 5 is a cross-sectional view of the second embodiment of the present invention as taken along line 5—5 in FIG. 4.

FIG. 6 is a second cross-sectional view of the second embodiment of the invention taken along line 6—6 in FIG. 4.

FIG. 7 is a front plan view of a third embodiment of the present invention.

FIG. 8 is a cross-sectional view of the third embodiment of the present invention as taken along line 8—8 in FIG. 7.

FIG. 9 is a second cross-sectional view of the third embodiment of the present invention as taken along line 9—9 in FIG. 7.

FIG. 12 is a perspective view of the fourth embodiment of the present invention.

FIG. 13 is a cross-sectional view of the fourth embodiment of the present invention as taken along line 13—13 in FIG. 12.

FIG. 14 is a second cross-sectional view of the fourth embodiment of the invention as taken along line 14—14 in FIG. 12.

FIG. 15 is a perspective view of the fifth embodiment of the present invention.

FIG. 16 is a cross sectional view of the fifth embodiment of the present invention as taken along line 16—16 in FIG. 15.

FIG. 17 is a cross sectional view of the fifth embodiment of the present invention as taken along line 17—17 in FIG. 15.

DETAILED DESCRIPTION OF THE DRAWINGS

Figure 10:
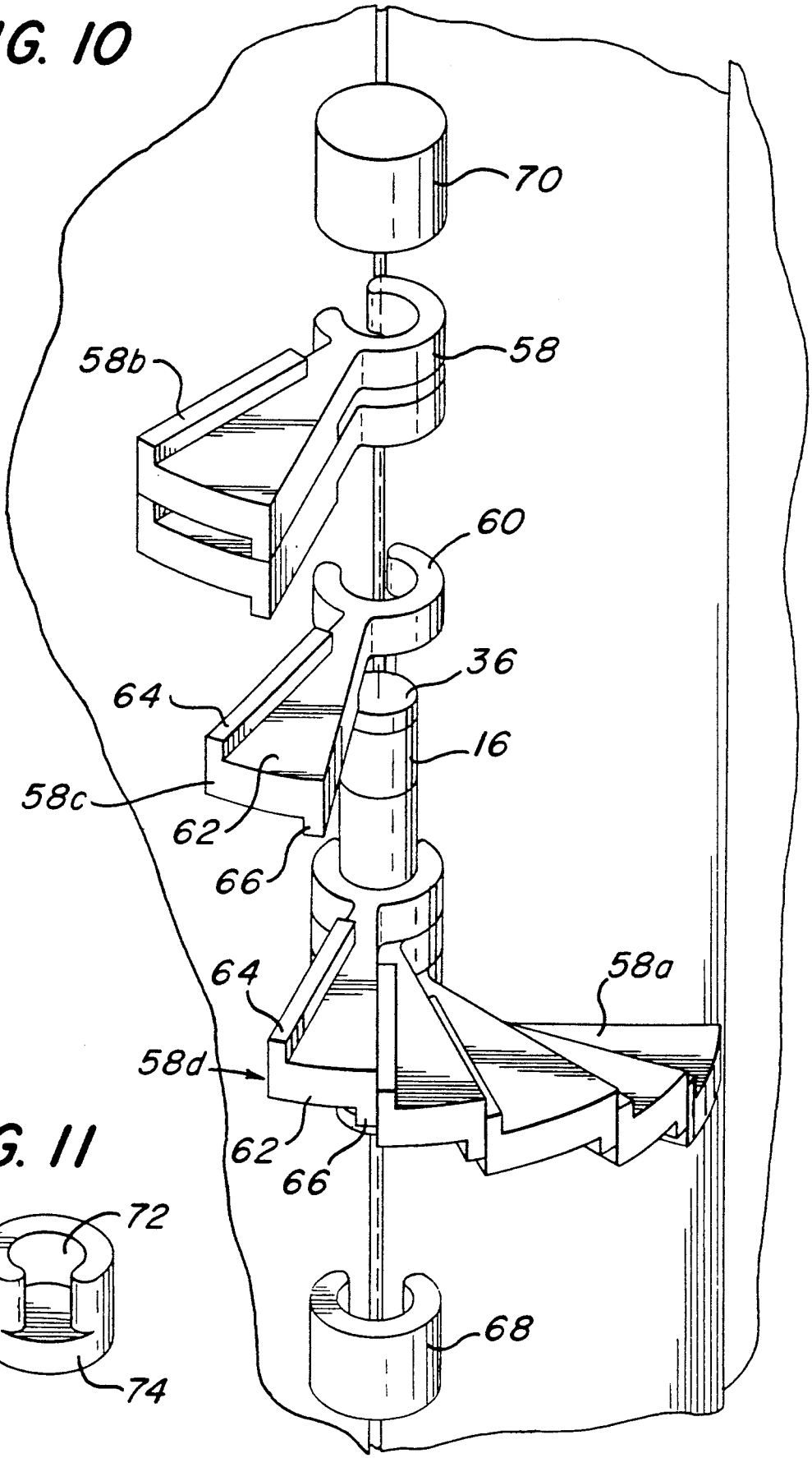
FIG. 10 is an exploded perspective view of the third embodiment of the invention as illustrated in FIGS. 7-9.

In the drawings where like numerals indicate like elements, there is shown a detachable door locking element which is generally referred to in FIG. 1 by the numeral 10. Element 10 as illustrated in FIG. 1 is secured in contact with a door 12 and a door frame 14. The door 12 is a standard type door which is secured to the frame 14 by means of hinges 16. The door frame 14 generally includes a molding 18 which surrounds the opening in which the door 12 is maintained.

In FIG. 2, there is a cross-sectional view of the locking element 10, door 12 and door frame 14. The detachable locking element 10 generally includes a door contact member 20 and a door frame contact member 22. The door contact member 20 and the door frame contact member 22 are attached to one another by a hinge portion 21 such that they pivot about one another to engage the door hinge 16. The pivoting of the member 20 with respect to member 22 about the pivot 21 also forms a pie-shaped slot 30 facing away from the door 12. Spacer means 24 is provided to fix the position of the contact members 20, 22. The spacer means includes a threaded bolt 26 which is provided between the door contact member 20 and the door frame contact member 22. Bolt 26 is secured within a threaded opening 28 in contact member 22. The end of the bolt 26 extends through the pie-shape slot 30 and into contact with seat 32 within door contact member 20.

As illustrated in FIG. 3, an attachment portion 34 is formed on the door frame contact member 22 that overhangs the hinge pin 36 of door hinge 16. The overhanging portion 34 generally covers the top of the slot formed on the door side of hinge 21 as the two members 20, 22 of the element wrap around the door hinge 16. Attachment portion 34 permits the locking element 10 to be positioned on top of the door hinge 16 of any door and to be removed easily therefrom as desired. Manifestly, the hinge pin 36 of door hinge 16 need not be removed in order to attach the locking element 10 of the present invention.

The locking element 10 is secured in a locking position by rotation of bolt 26 within bore 28, causing a pivoting of the door contact member 20 with respect to door frame contact member 22 and an enlargement of the pie-shaped slot 30. Thus, the locking element 10 may be adapted to conform to the angular relationship between the door 12 and the door frame 14 including its molding 18. When the locking element 10 is properly secured, the door 12 will be prevented from opening about the hinges 16. Also, the locking element 10 may be set, by adjustment of the spacer means, to prevent the door from moving away from the its closed position completely or may be set to permit only a limited amount of opening to occur. When the door is desired to be left unlocked, the locking element may be removed from the hinge 16 and the restrictions on the door are lifted.

Locking element 10 as illustrated in FIGS. 1-3 is generally contemplated to be made of a plastic material. A resilient pad may also be included on the contact surfaces so that marking of the door 12 or molding 18 is prevented. Also illustrated is an alarm mechanism 23. The alarm 23 generally includes a contact switch 25 which is mounted within the contacting surface of the door contact member 20. The switch 25 is connected to an alarm circuitry which is retained within housing 27. It is contemplated that an appropriate circuit could be provided for either a visual or audible alarm upon an attempt to open the door 12 while the locking element 10 is positioned on the door hinge 16. The switch 25 would be placed into contact with the door 12 at setup with the door contact portion 20 being slightly off contact with the door surface. Thus, when the door 12 opening is attempted, the door compresses the switch 25 and activates the alarm within the housing 27. Moreover, the locking element 10 prevents further opening of the door 12 and access through the doorway.

In FIGS. 4-6, there is illustrated a second embodiment of the present invention. In this second embodiment, the locking element 40 is formed by a series of pie-shaped elements 42-48. Pie-shaped element 42 generally forms a door contact member similar to contact member 20 in locking element 10. Pie-shaped element 48 generally forms the door frame contact member. A pivotable tab 50 is secured to the pie-shaped element 48 such that it may overhang the top of the hinge 16.

Pie-shaped elements 44 and 46 generally form spacer means in that they are insertable into the gap between elements 42 and 48 which form the contact members for the locking element 40. The pie-shaped element 42-48 generally includes a projecting dove tail 52 and a corresponding dove tail slot 54 for attachment of each element to one another to form an integral structure. The width of pie-shaped elements 44 and 46 will set the relative angular position of the contact surfaces for pie-shaped elements 42 and 48. If a door is provided without molding, a different size element 44 may be utilized. Moreover, if the contact surface for frame member 48 is perpendicular to the surface of the door 12, another size pie-shaped element 46 may be utilized. Thus, by choosing the proper combination of pie-shaped elements 42-48, the angular position for the locking element 40 may be adjusted.

In FIGS. 7-10, there is shown a third embodiment of a detachable door locking element 56. In this third embodiment, the door contact member, door frame contact member and the spacer means are each formed by a series of identically-shaped step elements. When assembled in the proper format, the series forms a fan which extends between the door 12 and the door frame 14. As illustrated in FIGS. 7, 8 and 10, step element 58A forms the door frame contact member. A separate step element 58B forms the door frame contact member. Step elements 58C, 58D, etc. are positioned between the contact elements 58A and 58B to complete the fan shape. Each step-shaped element includes an attachment portion 60 having an opening which is adapted to be slid over the outside of the hinge 16. The step-shaped elements also include a projecting portion 62 having two contact surfaces 64 and 66. Contact surface 64 is formed on one side of the projecting portion 62 and projects upwardly therefrom. Contact portion 66 is formed on the opposite side of projection 62 and projects downwardly. When the step-shaped elements are positioned about the hinge 16, the contact surface 64 of one element will be positioned adjacent to the contact surface 66 of the second element. As illustrated in FIG. 10, the contact surface 66 of element 58C is positioned adjacent to the upwardly projecting contact element 64 of element 58D. The contact elements 58 on either side of these elements form an additional step such that the gap between elements 58A and 58B is completely filled. As seen in the cross-sectional view of FIG. 8, the steps complete the arc between the molding 18 on door frame 14 and the door surface 12.

Figure 11:
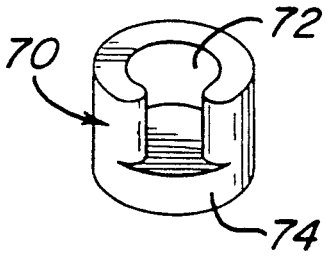
FIG. 11 is a perspective view of a portion of the third embodiment of the invention as illustrated in FIGS. 7-10.

The attachment means of locking element 56 is generally formed by a lower and upper cap 68 and 70, respectively. Lower cap 68 is adapted to slide onto the bottom of the hinge 16 and form a tight fit therewith. As seen in FIG. 11, the cap generally includes an arcuate opening 72 and a bottom fixing element 74. Fixing element 74 generally sets the starting position of the step-shaped elements and will engage attachment portion 60 of element 58A. Cap 70 is generally formed similar to bottom cap 68. As illustrated in FIGS. 7 and 10, cap 70 may be longer than cap 68 so that the entire hinge 16 is covered. The dimensions of these cap elements 68, 70 will depend on the thickness of attachment portion 60 of the step-shaped elements 58 and the number of steps required to lock the door.

In FIGS. 12-14, there is shown a fourth embodiment of a locking element 76 as contemplated by the present invention. Locking element 76 includes a door contact member 78 which is integrally formed with the attachment means 80. Attachment means 80 includes a slot 81 that fits over the hinge 16 and a stop portion 83 forming a cap that rests on the hinge pin 36. Door frame contact member 82 is attached to the door contact member 78 by means of pins 90. Adjustment of the locking element 76 is performed by adjustment means 84 having a threaded bolt 86 with a contact bumper 88 on one end. Rotation of the bolt 86 moves the bumper 88 toward or away from the door frame 14 so as to set the locking position. Further adjustment may be made by means of the pins 90 which are secured within openings 91 and which extend through the door frame contact member 82 and the door contact member 78. There are a number of openings 91 provided such that the relative extension of the door frame contact member 80 may be adjusted with respect to door contact member 78.

The embodiment of the locking element 92 shown in FIGS. 15-17 is similar in form to that shown in FIGS. 4-6. Element 92 includes a series of pie shaped elements 42', 44', 48' of similar size and shape. In addition a pie-shaped mounting element 46' is included. Each of the pie-shaped elements 42'-48' include a matching set of groves and slots, such as dove tail projection 52 and dove tail slot 54, which interengage to removably secure the elements together. Element 46' is formed as the starter element for mounting locking element 92 on the door hinge 16. Element 46' is secured onto the hinge 16 by means of mounting cap 94. Mounting cap 94 includes projections 96 which are secured within holes in the body of element 46'. Once the element 46' is secured to the cap 94, the remaining elements 42', 44', and 48' are secured thereto to form a completed lock 92. It should be noted that the size of elements 42'-48' may be varied so as to adjust the size of the locking element 92 and the position of its contact with the door 12 and the molding 18 of door frame 14.

The present invention may be embodied in other specific forms without departing from the spirit or essential attributes thereof and, accordingly, reference should be made to the appended claims, rather than to the foregoing specification, as indicating the scope of the invention.

I claim:

1. A detachable door lock for attachment to a door hinge to maintain the door in a desired closed position, the door lock comprising:

a door contact member;

a door frame contact member attached to the door contact member;

spacer means for fixing a range of positions that the door contact member can have with respect to the door frame contact member; and attachment means formed integrally with the door contact member and the door frame contact member for releasably securing the door contact member and door frame contact member to the door hinge, wherein the door frame member and door contact member are angularly movable with respect to each other, and wherein the spacer means is generally formed by a threaded bolt attached to the door frame contact member and in contact with the door contact member so as to allow for adjusting of the angular position with respect to each other about the attachment means.

2. A detachable door lock for attachment to a door hinge to maintain the door in a desired closed position, the door lock comprising:

a door contact member;

a door frame contact member attached to the door contact member;

spacer means for fixing a range of positions that the door contact member can have with respect to the door frame contact member;

attachment means formed integrally with the door contact member and the door frame contact member for releasably securing the door contact member and the door frame contact member to the door hinge; and alarm means, the alarm means having an actuation means that initiates an alarm upon opening of the door.

3. A detachable door lock as claimed in claim 2 wherein the actuation means includes a contact switch means, the contact switch means having a projection thereon which extends from the door contact member so as to engage the door when the door lock is positioned on the door hinge.

4. A detachable door lock for attachment to a door hinge to maintain the door in a desired closed position, the door lock comprising:

a door contact member;

a door frame contact member attached to the door contact member;

spacer means for fixing a range of positions that the door contact member can have with respect to the door frame contact member;

attachment means formed integrally with the door contact member and the door frame contact member for releasably securing the door contact member and door frame contact member to the door hinge; and hinge means pivotally connecting the door frame contact member and the door contact member, wherein the door frame member and door contact members are movable with respect to each other.

5. A detachable door lock for attachment to a door hinge to maintain the door in a desired closed position, the door lock comprising: a door contact member; a door frame contact member attached to the door contact member; spacer means for fixing a range of positions that the door contact member can have with respect to the door frame contact member; and attachment means for releasably securing the door contact member and door frame contact member to the door hinge, wherein the door frame contact member and the door contact member are shaped relatively like a sector of a pie with one flat surface of the door frame contact member serving as the contact surface for the door frame and one flat surface of the door contact member serving as the contact surface for the door.

* * * * *